United States Patent [19]

Vogel

[11] Patent Number: 5,031,349

[45] Date of Patent: Jul. 16, 1991

[54] METHOD FOR ALIGNING FIREARM SIGHTS USING LASER LIGHT

[75] Inventor: Stephen K. Vogel, Fairfield, Conn.

[73] Assignee: Sturm, Ruger & Company, Inc., Southport, Conn.

[21] Appl. No.: 503,647

[22] Filed: Apr. 3, 1990

Related U.S. Application Data

[63] Continuation of Ser. No. 90,271, Aug. 27, 1987, abandoned, which is a continuation of Ser. No. 816,767, Jan. 7, 1986, abandoned.

[51] Int. Cl.[5] ..... G01L 5/14

[52] U.S. Cl. ..... 42/103; 73/167; 42/100; 89/37.04

[58] Field of Search ..... 42/100, 103, 94; 33/248, 234, 286, DIG. 21; 356/153; 73/167; 89/37.04, 41.19

[56] References Cited

U.S. PATENT DOCUMENTS

| | | | |
|---|---|---|---|
| 1,048,975 | 12/1912 | Konig | 42/100 |
| 1,826,004 | 10/1931 | Key | 42/103 |
| 2,378,545 | 6/1945 | Fraser et al. | 73/167 |
| 2,641,056 | 6/1953 | Eccleston | 33/234 |
| 2,844,710 | 7/1958 | Zinsser | 42/103 |
| 3,782,832 | 1/1974 | Hacskaylo | 42/100 |
| 4,079,534 | 3/1978 | Snyder | 42/103 |
| 4,233,770 | 11/1980 | de Filippis et al. | 42/103 |
| 4,530,162 | 7/1985 | Forrest et al. | 33/228 |

*Primary Examiner*—Michael L. Carone

*Attorney, Agent, or Firm*—Pennie & Edmonds

[57] ABSTRACT

A method for aligning adjustable sights on a firearm with the point of bullet impact at a given range in which the sights are aligned during firing range testing including the use of a laser beam unit mounted on the firearm sights which beam indicates the alignment of the sights vis-a-vis the target.

8 Claims, 3 Drawing Sheets

10
18

14
18
5
5
10
19
6
6
27
31

27
29

14
18
19
29
27

METHOD FOR ALIGNING FIREARM SIGHTS USING LASER LIGHT

RELATED APPLICATIONS

This application is a continuation of U.S. application Ser. No. 07/090,271 filed Aug. 27, 1987, now abandoned, which in turn, was a continuation of U.S. application Ser. No. 816,767 filed Jan. 7, 1986 now abandoned.

BACKGROUND OF THE INVENTION

Prior gun sight alignment systems have depended on a worker's eye to judge the amount of sight adjustment required to make the bullet's impact coincide with the alignment of the front and rear sights of the gun. This process is generally called "zeroing in" the firearm. It has been the practice to initially adjust the sight to generally center each adjustable part vis-a-vis the barrel with each so positioned for elevation and for windage. Thereafter, the firearm is range tested by firing at a target and comparing holes in the target with the sight alignment as made with the tester's eye. The sights are then moved so that their alignment coincides with the bullet holes in the target. Thereafter when the gun is aimed and fired properly by the user, the bullets will strike where the sights indicate. The gun is then considered to be "zeroed in" and accurate shooting is now possible.

To aid in comparing target hits with the sight position relative to the barrel, telescopes have been suggested (U.S. Pat. No. 1,048,975). It has also been proposed to use lasers to align pipe conduit sections, pipe mill rollers, and machine turning tools (U.S. Pat. Nos. 3,631,601; 4,319,406; and 4,417,816).

Of relevance also is the prior suggestion of aligning sights on a gun by using two intersecting light beam sources; one beam through the bore of the barrel and one beam from a position above the barrel (U.S. Pat. No. 3,782,832).

No previous sight alignment system has used a laser to describe the actual line of sight on the target so as to simplify the process of aligning the path of the bullet with the sights.

SUMMARY OF THE INVENTION

Broadly, this invention is a method of adjusting a firearm's sighting mechanism comprising (1) locating the firearm at a fixed distance from a target including a target sector; (2) mounting on the sights a laser unit which projects a beam or laser light at the target; (3) adjusting the firearm until the sight mounted laser unit projects its beam tanget to the target section; (4) firing the firearm to cause a hole in the target; (5) comparing the target bullet hole with the target section; and (6) thereafter adjusting the sights. By moving the sights on which the laser is mounted so that the laser beam intersects the bullet hole, the firearm is then "zeroed in".

The method is carried out using (a) an adjustable range holder for holding the firearm; (b) a target including a target sector positioned a selected distance from the fixture; and (c) a laser unit removably mountable on the sights which laser unit emits a laser light beam substantially parallel to and above the barrel which beam shines on the target.

It is a feature of the invention that the barrel of the firearm can be prealigned with the laser beam prior to range testing, resulting in great economy in the expenditure of labor and ammunition to "zero in" the firearm.

DESCRIPTION OF THE PREFERRED EMBODIMENT

Figure 1:
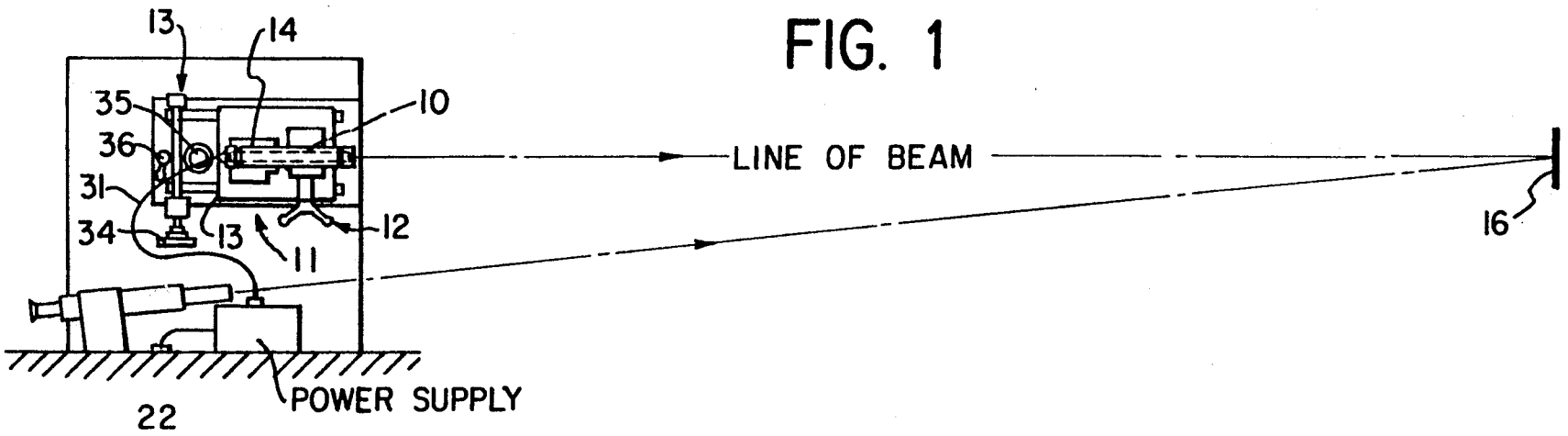
FIG. 1 is a schematic plan view of the range testing system.
Figure 2:
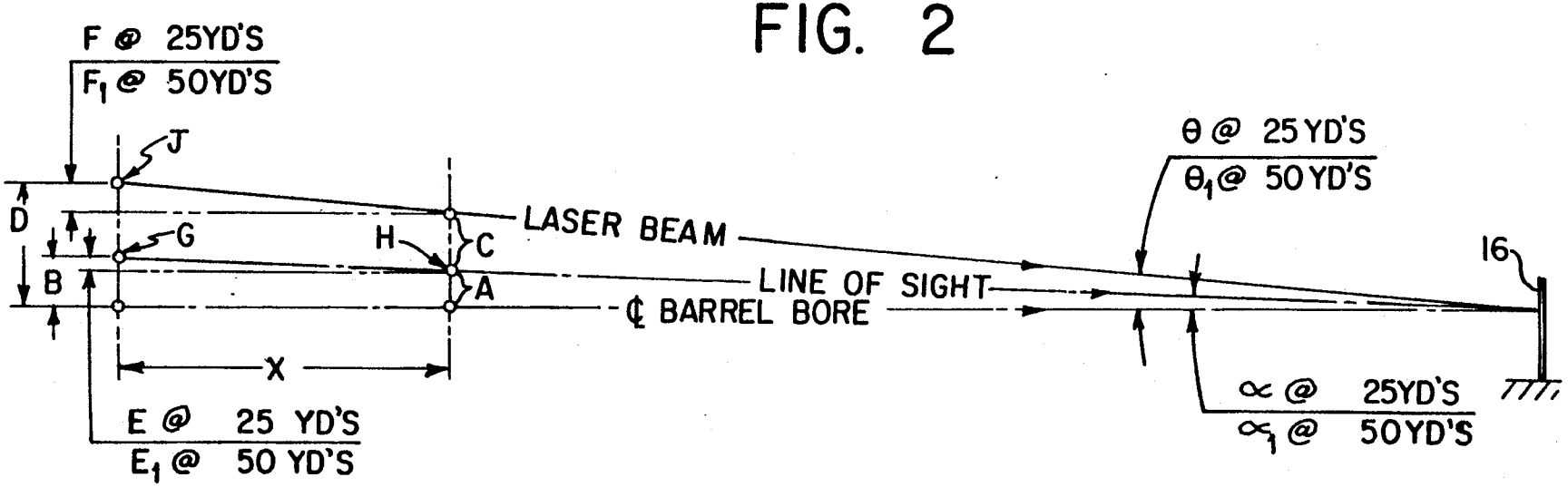
FIG. 2 is a schematic elevational view showing triangulation of the sighting and alignment arrangements.
Figure 3:
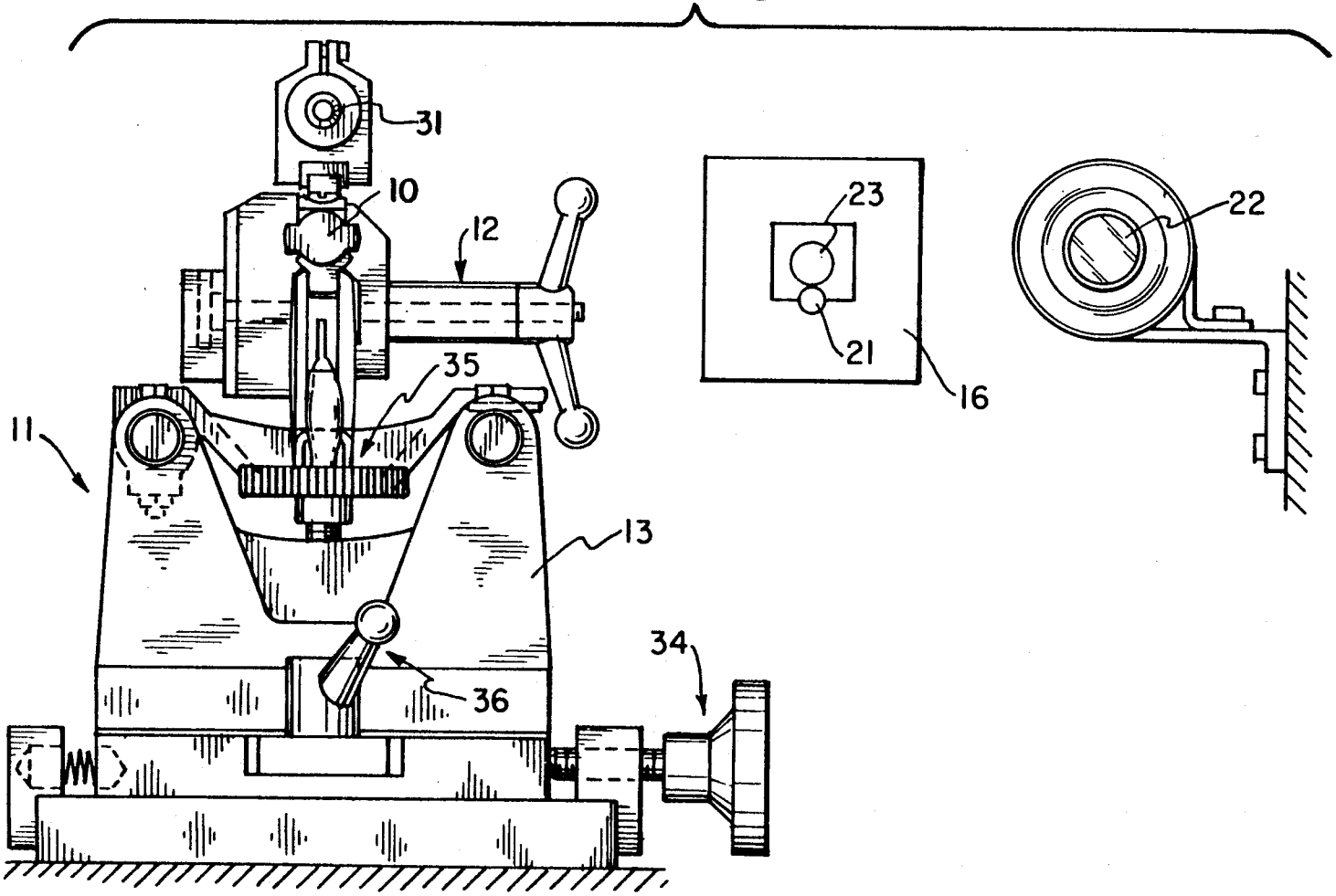
FIG. 3 is a forward looking view of the firearm holding apparatus including separate depictions of target and spotting scope.

In FIGS. 1-3, firearm 10 (shown in dashed lines) is mounted on fixed machine rest unit 11. Machine rest unit 11 includes firearm clamp 12 and movable carriage 13. Laser head unit 14 is mounted on firearm 10 as further shown.

After firearm 10 has been assembled in the factory and its rear sight components prealigned, it is placed in and secured through clamp 12 to unit 11 for aiming, firing and further rear sight component adjustment. Range target 16 is positioned a selected distance down range from the firearm 10 (FIG. 2). The portable laser unit 14 is placed on the sights 18, 19 where it perches without further support. Conduit 31 supplies power to unit 14.

Laser unit 14 is energized and the location of the light beam spot 21 on target 16 is observed with the naked eye or spotting scope 22 (see FIG. 3). If the laser target spot 21 is located below and tangent to bull's eye (target sector) 23, no adjustment of firearm rest unit 11 is required. If spot 21 is located elsewhere, unit 11 (with firearm 10 clamped to it) is adjusted until laser spot 21 is located below and tangent to target sector 23.

Figures 4, 5, 6, 7:
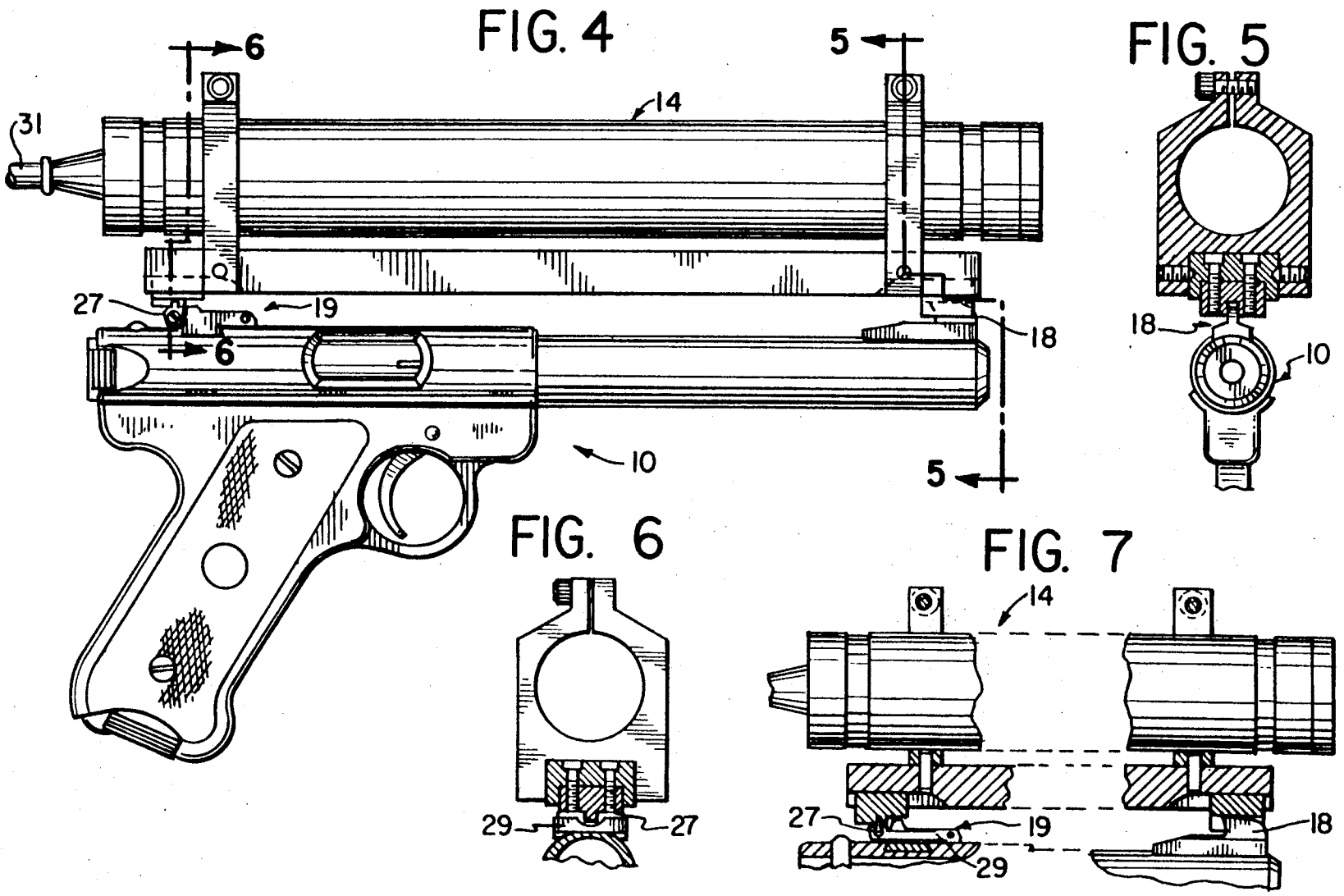
FIG. 4 is a side elevational view of the laser unit mounted on the firearm sights.
FIG. 5 is a sectional view taken along line 5—5 of FIG. 4.
FIG. 6 is a sectional view taken along line 6—6 of FIG. 4.
FIG. 7 is a partial exploded enlarged view showing the laser unit positioned on the firearm sights.

A round is then fired down range through target 13. If the bullet does not pass through target sector 23, rear sight assembly 19 is adjusted by moving notch piece 27 left or right (FIG. 4) or elevating or lowering arm 29 (FIG. 7) or by making both adjustments. A second round, or group of rounds, are then fired. This sequence continues until proper range-test adjustment of rear sight assembly 19 is attained.

Turning to FIG. 2 the triangulation formed by the target, the barrel bore, line of sight (through the front and rear sights 18, 19) and laser beam is schematically shown. The following letters are used: G is rear sight; H is a front sight; J is the laser light source; A is the distance the front sight is above the barrel bore; and C is the distance laser beam passes above front sight. The laser unit 14, being mounted on the pistol sights 18, 19, is elevated several inches above a line of sight as viewed by eye through the rear and front sights. To compensate for this fact, the laser unit 14 may be constructed to point slightly downwardly so that the laser beam strikes the target (at 25 or 50 yds. distance) at the same point as the line of sight.

Referring back to FIG. 3, it is seen that adjustable rest unit firearm holder 11 has firearm clamp 12 which secures firearm 10 to carriage 13. Carriage 13 has horizontal adjustment means 34, vertical adjustment means 36 and locking means 37 to lock unit 11 in a selected position for firing the firearm.

I claim:

1. A method of adjusting firearm sights in elevation and windage comprising (1) placing a sight-unadjusted firearm in an adjustable holder means;

(2) placing a target including a target sector at a selected distance from the holder means;

(3) mounting on the firearm sights a portable detachable laser unit which unit includes a frame having an axis adapted to sit on the sights and a laser projection means which projects a beam of laser light at the target which beam has a beam axis, the frame axis and laser projection means beam axis held in the unit in a fixed non-parallel unadjustable relationship the angle between the frame axis and the beam axis being selected based on triangulation of laser axis, barrel axis and selected target distance;

(4) adjusting the holder means to cause the firearm to move until the sight mounted laser unit projects its laser beam on the target to create a visible light spot adjacent to the target sector which visible light spot indicates the sight settings;

(5) firing the firearm to cause a bullet hole in the target;

(6) comparing the target bullet hole with the target sector; and (7) thereafter adjusting the sights while observing the laser beam light spot on the target.

2. The method of claim 1 in which there is a subsequent firing of the firearm and the sights are further adjusted as necessary.

3. Apparatus for sighting a firearm having a barrel and having adjustable sights including a rear sight which requires adjustment for proper firing comprising (a) a target penetratable by a bullet;

(b) a firearm holder positioned a selected distance from the target for holding the firearm;

(c) a portable laser means including a laser unit capable of projecting a light beam along a beam axis onto the target and an elongated frame unit which frame unit has an elongated frame axis which laser and frame units are permanently aligned with an angle between the beam axis and frame axis based on selected target distance and where the laser beam axis as superimposed over the frame axis both lie in a vertical plane whereby the light beam on the target is indicative of the then position of such sights.

4. The apparatus of claim 3 in which the beam axis points slightly downwardly with respect to the frame axis.

5. The apparatus of claim 3 in which the holder means is adjustable.

6. The apparatus of claim 3 in which the said vertical plane passes through the firearm barrel axis.

7. The apparatus of claim 3 in which said vertical plane passes at an angle to the firearm barrel axis as the rear sight is adjusted left and right.

8. The apparatus of claim 3 having in addition a telescope positioned to view the light beam striking the target.

* * * * *